United States Patent [19]

Appleman et al.

[11] Patent Number: 4,521,044

[45] Date of Patent: Jun. 4, 1985

[54] TWISTLOCK OPERATOR

[75] Inventors: William S. Appleman, Durham; James D. Sturgill, Roxboro, both of N.C.

[73] Assignee: RPC Corporation, South Roxboro, N.C.

[21] Appl. No.: 477,323

[22] Filed: Mar. 21, 1983

[51] Int. Cl.[3] ..... B66C 1/66

[52] U.S. Cl. ..... 294/82.24; 294/81.1; 403/300

[58] Field of Search ..... 294/67 R, 67 DA, 81 R, 294/81 SF, 83 R; 24/287; 403/300, 301, 305; 410/82, 83; 464/153, 154

[56] References Cited

U.S. PATENT DOCUMENTS

| | | | |
|---|---|---|---|
| 1,577,575 | 3/1926 | Geiger | 464/154 |
| 2,471,974 | 5/1949 | O'Malley | 464/154 |
| 3,677,599 | 7/1972 | Shannon | 294/81 SF X |
| 3,749,438 | 7/1973 | Loomis et al. | 294/81 SF |
| 3,829,145 | 8/1974 | Gottlieb et al. | 294/81 SF |
| 4,215,892 | 8/1980 | Holmes | 294/81 SF |

*Primary Examiner*—Johnny D. Cherry
*Attorney, Agent, or Firm*—Shlesinger Arkwright Garvey & Fado

[57] ABSTRACT

A twistlock operator for a twistlock mechanism has a drive mechanism with a fixed axis and an angularly displaceable twistlock having a pivot axis normally positioned along the fixed axis. A first actuator is drivingly connected to the drive mechanism for thereby permitting rotation of the first actuator and a second actuator is connected to the twistlock. Each of the actuators is generally rectangularly shaped and each has arcuate side bearing surfaces and the bearing surfaces have substantially equal radii of curvature. A tube is pivotally connected to each of the actuators for drivingly connecting the actuators and thereby causing cooperative rotation of the actuators. The tube maintains driving connection between the actuators even when the twistlock pivots and thereby displaces the pivot axis away from the fixed axis.

19 Claims, 7 Drawing Figures

TWISTLOCK OPERATOR

BACKGROUND OF THE INVENTION

The use of containerized cargo units in shipping has increased in the past several years. The shipping of cargo in containerized units is highly efficient and allows a relatively large amount of cargo to be handled and shipped in a single package or cargo unit. The containerized cargo unit, therefore, minimizes the need to load and unload relatively small amounts of cargo and significantly decreases the handling times attributable thereto.

A typical containerized cargo unit is a rectangular box-type housing or container into which the cargo may be loaded and unloaded. The loaded containerized cargo unit may readily be moved from truck to railroad car to ship or to barge, as may be needed. Generally, a crane, forklift truck, or other lifting mechanism is used to lift the containerized cargo unit from a first mode of transportation to a second mode of transportation.

The upper rectangular surface of the containerized cargo unit contains, generally, four twistlock receiving members or corner fittings or female receptacles located at its four corners. A corner member is, generally, a plate structure having a particularly sized aperture designed to receive a twistlock and to permit rotation of the twistlock and its lugs for achieving locking or unlocking connection with the corner member. The twistlocks, or male members, extend from the lower frame of a fixed length or expandable length spreader. The spreader is a grapple suspended from a crane, or other lifting mechanism, which is aligned over the containerized cargo unit to be lifted. The spreader includes twistlocks which are to be aligned with the appropriate corner members for insertion therein.

Containerized cargo units come in any one of a number of sizes. Cargo units conforming to standards set by the International Organization for Standardization (ISO) and the American National Standards Institute (ANSI) have nominal container lengths from ten feet to forty feet but always have a nominal width of eighty-nine inches, measured from the center of one corner member to the center of the opposite corner member. An expandable spreader may be expanded or retracted to match the length required to align the twistlocks with the twistlock corner members at the four corners. Unfortunately, not all cargo units conform to the ISO-ANSI standards and this lack of uniformity may increase the time required to unload or load cargo units.

An example of a cargo unit not meeting ISO-ANSI standards is the Sealand system which has the center of the opening in the corner members at four-hundred and twenty inches in the longitudinal direction and ninety inches in the lateral direction.

Because of the differences in width or lateral spacing of the corner members of the Sealand and the ISO-ANSI system, it is necessary to either change the spreader or to use a spreader designed to accommodate both systems. Should the wrong spreader be used, then not all twistlocks will align with their respective corner members. Since twistlocks are, normally, rotated by means of hydraulic cylinders, improper positioning or misalignment of a twistlock may cause a malfunction such as jamming and a failure to release resulting in increased loading or unloading time.

Previous twistlocks designed to accommodate the ISO-ANSI system and the Sealand system, of which Loomis, U.S. Pat. No. 3,749,438, is an example, frequently jam because the torque on the twistlock caused by the operating or rotating means of the twistlock tends to force the twistlock to cant which may prevent the twistlock from entering into or releasing from the twistlock corner members.

Consequently, a new and improved twistlock operator having the capability of allowing the twistlock to accommodate various dimensional differences and to prevent malfunction of the twistlocks with the twistlock receiving members is necessary.

OBJECTS AND SUMMARY OF INVENTION

A primary object of the disclosed invention is to provide a twistlock operator capable of accommodating both the ISO-ANSI system and the Sealand system.

A further object of the disclosed invention is to provide a twistlock operator which prevents binding of the twistlock with the corner member.

Still a further object of the disclosed invention is to provide a twistlock operator which allows the twistlock to enter into or be released from the twistlock corner member at all times.

Yet a further object of disclosed invention is to provide a twistlock operator which will accommodate angular displacement of the twistlock.

Yet still a further object of the disclosed invention is to provide a twistlock operator which is displacable and allows access to the twistlock.

Yet still a further object of the disclosed invention is to provide a twistlock operator which can be used with cargo container corner fittings having slightly different lateral spacing as well as different receptacle configurations.

Yet another object of the disclosed invention is to provide a twistlock operator which can be used with a telescoping lifting spreader to enable cargo containers of various lengths to be handled by the same spreader.

Still a further object of the disclosed invention is to provide a universal connection between the twistlock rotating means and the twistlock.

These and other objects and advantages of the invention will be readily apparent in view of the following description and drawings of the above described invention.

DESCRIPTION OF THE DRAWINGS

The above and other objects and advantages and novel features of the present invention will become apparent in the following detailed description of the preferred embodiment of the invention illustrated in the accompanying drawings, wherein.

DESCRIPTION OF INVENTION

The twistlock operator of the invention is, preferably, used with a twistlock locator such as in Loomis et al, U.S. Pat. No. 3,749,438, and that patent is incorporated herein by reference.

Figure 2:
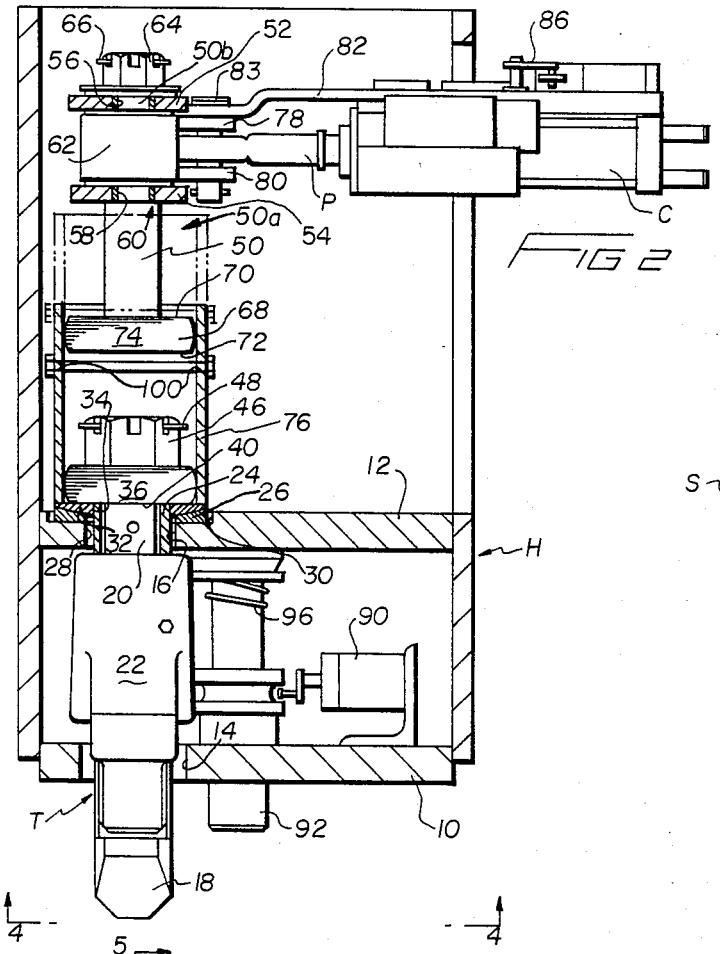
FIG. 2 is a fragmentary cross-sectional view taken along the sections 2—2 of FIG. 1 and viewed in the direction of the arrows.
Figure 5:
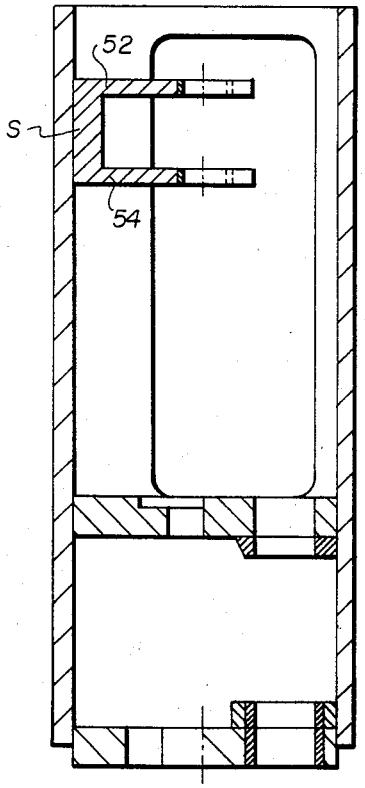
FIG. 5 is a cross-sectional view taken along the section 5—5 of FIG. 4 and viewed in the direction of the arrows.

As best shown in FIG. 2, a twistlock assembly T, substantially as described in Loomis, is mounted in a housing H which is connected to a spreader (not shown). Housing H has a lower integral closure plate 10 and a support 12 intermediate the height of housing H and spaced a distance from closure plate 10 and parallel with closure plate 10.

Closure plate 10 has an aperture 14 and support 12 has a cooperating aperture 16 coincident with aperture 14.

A twistlock 18 extends from the lower surface of bottom closure 10 and includes a shaft 20 extending therefrom and passing through cooperating apertures 14 and 16. Shaft 20 is, preferably, threaded on its upper most end. A guide block 22 is removably mounted on shaft 20 and is in contact with twistlock 18. Locking sleeve 24 is mounted on shaft 20 and positioned in contact with a shoulder on shaft 20 (not shown). It should be pointed out that the aperture 16 has a diameter slightly larger than the diameter of locking sleeve 24 so as to permit angular displacement of shaft 20 and locking sleeve 24 in the aperture 16. A first washer 26 having a central aperture 28 is positioned around locking sleeve 24 and is mounted in annular recess 30 of support 12. Preferably, washer 26 has a lower substantially flat surface for cooperating with the substantially flat surface of recess 30 and an upper opposed convex surface. Central aperture 28 has a diameter exceeding the diameter of locking sleeve 24 and is at least as great as the diameter of aperture 16. A second washer 32 having a central aperture 34 is positioned around locking sleeve 24. Washer 32 has a lower concave surface which is in substantially abutting sliding cooperating relationship with the convex surface of washer 26. Washer 32 has an upper substantially flat surface opposed from the concave surface thereof.

Figure 1:
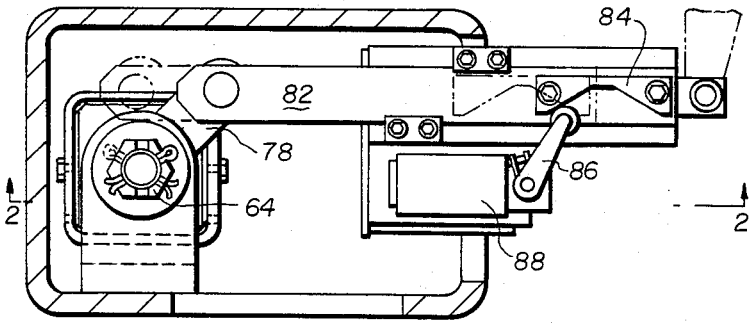
FIG. 1 is a top plan view of the new improved twistlock operator mounted in a housing on the lower side of a spreader frame.
Figure 3:
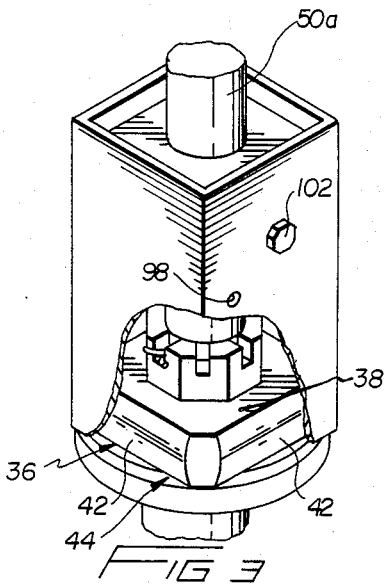
FIG. 3 is a fragmentary perspective view of the twistlock operator of the invention and with portions broken away.

A first actuator 36 is mounted on shaft 20 and has a lower substantially flat surface in abutting relationship with the substantially flat surface of washer 32. Actuator 36, as best shown in FIG. 3, is, preferably, square in cross-section. Actuator 36 includes upper substantially flat surface 38 and lower substantially flat surface 40, as best shown in FIG. 2. Arcuate side surfaces 42 are disposed between upper surface 38 and lower surface 40. Preferably, actuator 36 includes four corners 44 which are rounded off or truncated.

Referring again to FIG. 2, a lock nut 46 is threaded onto the uppermost end of shaft 20 and is tightened until a substantially rigid member is established extending from actuator 36 to locking sleeve 24, shoulder of shaft 20 (not shown) and twistlock 18. In this way, as twistlock 18 is angularly displaced so as to accommodate the ISO-ANSI or the Sealand system, the rigid connection causes the actuator 36 to likewise be angularly displaced. Preferably, the upper end of shaft 20 will contain an aperture (not shown) to permit the introduction of a cotter pin 48, or other fastening means, so as to assure that locknut 46 is maintained in position and does not loosen. Preferably, actuator 36 may contain a key slot (not shown) and shaft 20 will contain a cooperating key slot (not shown) for receipt of a key (not shown) to further assure that actuator 36 is maintained in position.

A second shaft 50 is rotatably mounted in arms 52 and 54 of supports extending from housing H. Shaft 50 has a lower end **50*a* which has a diameter larger than the diameter of the aperture 56 of arm 52 and of the aperture 58 of the arm 54. In this way, shaft 50*a* has a shoulder 60 to precisely position the upper end 50*b* of shaft 50. Upper end 50*b* has a diameter corresponding to the diameter of apertures 56 and 58 and is rotatable in apertures 56 and 58. The upper end 50*b* of shaft 50 is threaded at its uppermost end. A clevis 62 is rotatably mounted on shaft 50*b* and is positioned between arms 52 and 54. A threaded lock nut 64 is threaded onto the upper end 50*b* of shaft 50 and is tightened to precisely position shaft 50. Preferably, upper end 50*b* includes an aperture (not shown) for receipt of a cotter pin 66 designed to ensure that lock nut 64** does not become loosened.

A second actuator 68 is positioned on the lower end **50*a* of shaft 50 and is substantially identical to actuator 36. Actuator 68 includes upper substantially flat surface 70 and lower substantially flat surface 72. Arcuate side surfaces 74 are disposed between surfaces 70 and 72. Preferably, arcuate side surfaces 74 have the same radius of curvature as do arcuate side surfaces 42 of actuator 36. Likewise, actuator 68 is, preferably, square in cross-section and is identical in size to actuator 36**.

Operator or tube member 76 is displaceably positioned between actuators 36 and 68 and serves to connect actuators 36 and 68. Operator 76 is preferably a hollow tubular member having an internal width corresponding to the external width of actuators 36 and 68. It should be appreciated that the sizing of the actuators 36 and 68 need not be identical as long as the operator 76 is capable of receiving both actuators 36 and 68. Consequently, actuators 36 and 68 may differ in size and also in configuration. Actuator 36 is positioned in the lower end of operator 76 and actuator 68 is positioned in the upper end of actuator 76. Because of the connection of actuators 68 and 36 by operator 76, rotation of shaft 50 will be imparted to operator 76 which will likewise impart the rotation to actuator 36 which will cause twistlock 18 to rotate.

Figure 6:
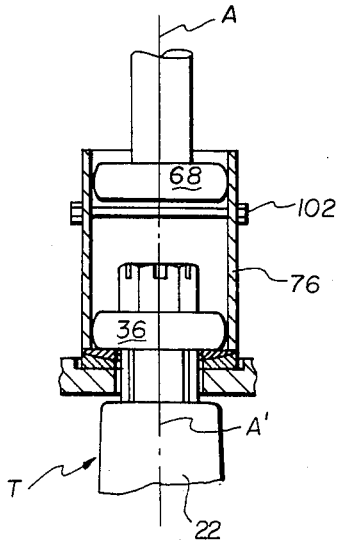
FIG. 6 is a fragmentary cross-sectional view of the twistlock operator of the invention in the normal position.
Figure 7:
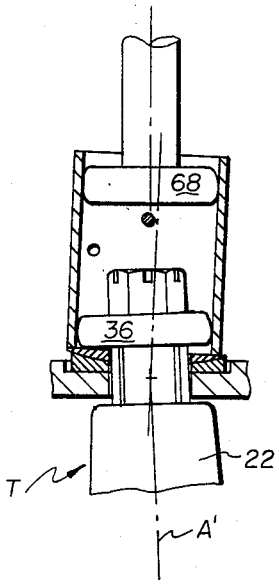
FIG. 7 is a fragmentary cross-sectional view of a twistlock operator as in FIG. 6 with the twistlock biased in one direction or canted due to the difference in the lateral spacing dimensions of the container corner fittings.

Should twistlock 18 be angularly displaced from its normal vertical axis A, as best shown in FIG. 6, which is coincident with the fixed axis A' of shaft 50, then actuator 36 will pivot because of washers 26 and 32 and the arcuate side surfaces 42 and 74 permit operator 76 to be angularly displaced on the fixed axis of shaft 50 while still maintaining connection with actuator 36 and 68, as best shown in FIG. 7. In this way, shaft 50 always maintains a fixed axis A while the axis A' of shaft 20 may be angularly displaced so as to accommodate either the ISO-ANSI or the Sealand twistlock system.

A cylinder C is mounted in housing H and has a piston or rod P connected to ears 78 and 80 of clevis 62. Rotation of shaft 50 is caused by the reciprocating displacement of piston P of cylinder C. Preferably, a follower 82 is connected to ear 78 and is displaceable with piston or rod P. Pin 83 maintains follower 82 and piston rod P in connnection with ears 78 and 80. Follower 82 may contain a contoured trip plate 84 designed to activate switch arm 86 of switch 88. Switch 88 is, preferably, used to monitor the displacement or rotation of shaft 50 and, consequently, of twistlock 18.

Figure 4:
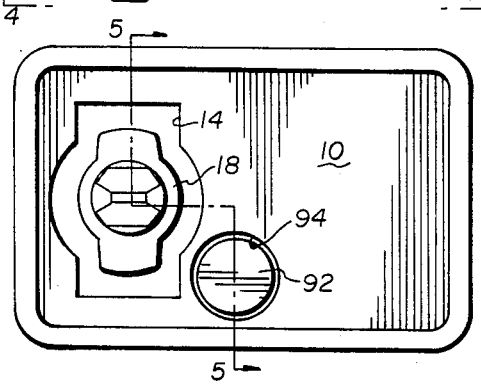
FIG. 4 is a bottom plan view taken along the section 4—4 of FIG. 2 and viewed in the direction of the arrows.

Preferably, a second switch 90 will be mounted to closure plate 10 and will be connected to plunger 92 passing through aperture 94 of closure plate 10, as best shown in FIG. 4. Plunger 92 may be springloaded such as by spring 96 to assure that plunger 92 always extends from the lower surface of closure plate 10. Plunger 92 will sense contact with a cargo container (not shown) and will activate switch 90 upon contact so to notify the operator of the connection.

Preferably, operator 76 will include apertures 98 and 100. Aperture 100 is transverse of shaft 50 and aperture 98 is positioned some distance from aperture 100 and below aperture 100 for reasons which will be explained. A lock bolt 102 is normally positioned in aperture 100, as best shown in FIG. 2, and because aperture 100 is slightly below actuator 68 in the normal operable position, as best shown in FIG. 2, the lock bolt 102 prevents the operator 76 from being displaced upwardly and out of connection with actuator 36. Lock bolt 102 when inserted in aperture 100 assures that the operator 76 maintains connection between actuators 68 and 36.

Should it be necessary to have access to actuator 36 or locknut 46 or to any part therein, removal of lockbolt 102 from aperture 100 allows the operator 76 to be displaced upwardly and out of connection with actuator 36, as best shown in dotted lines in FIG. 2. Insertion of lockbolt 102 in aperture 98 when the operator 76 has been sufficiently raised allows the operator 76 to be held above actuator 36 because the lockbolt 102 rests on the upper surface 70 of actuator 68 and prevents the operator 76 from being displaced downwardly. In this way the operator 76 is easily displaced so to allow maintenance of parts. Removal of lockbolt 102 from aperture 98 permits operator 76 to be displaced downwardly and interconnection with actuator 36 so that the twistlock assembly T may be used again.

As best shown in FIGS. 6 and 7, angular displacement of twistlock assembly T may be accommodated because shaft 50 always maintains its fixed axis A. The axis A' of shaft 20 may be displaced but because of the arcuate side surfaces 42 and 74, operator 76 is displaced with actuator 36 and yet maintains connection between actuators 68 and 36.

Previously, operation of piston or rod P of cylinder C has tended to cause twistlock 18 to be angularly displaced prior to or after insertion into the appropriate corner fitting (not shown). This angular displacement was due to the fact that the piston or rod P of cylinder C acting through the relatively long shaft 20 of twistlock 18 would cause the shaft 20 to be displaced. This displacement of twistlock 18 by the piston or rod P could prevent the twistlock 18 from entering a corner fitting (not shown) or could prevent a twistlock 18 from being removed from a corner fitting (not shown). Any delay in the insertion or removal of a twistlock 18 from a corner fitting part (not shown) results in lost time and increased costs. In view of the need to increase the efficiency of handling of containerized cargo units, this angular displacement of shaft 20 of twistlock 18 caused by piston or rod P of cylinder C is undesirable and the disclosed twistlock operator 76 provides a new and unique method of solving the problem of the biasing of the shaft 20 of the twist lock 18.

While this invention has been described as having a preferred design, it will be understood that it is capable of modification. This application, is, therefore, intended to cover any variations, uses, and/or adaptations of the invention following the general principles thereof and including such departures from the present disclosure as come within known or customary practice within the art to which this invention pertains, as it may be applied to the essential features herein before set forth and fall within the scope of this invention or the limits of the appended claims.

What we claim is:

1. A displacable rotation assembly for a twistlock mechanism operably associated with a drive mechanism having a fixed axis and an angularly displacable twistlock with a pivot axis normally positioned along said fixed axis; comprising:

(a) first means coupled with said drive mechanism;
(b) second means coupled with said twistlock;
(c) an angularly displacable operator having an angularly movable axis normally positioned on said fixed axis and connecting said first and said second means;
(d) whereby said operator will be displaced from said fixed axis while maintaining coupling between said first and said second means when said twistlock is angularly displaced from said fixed axis;
(e) said first means includes a first flat actuator having a shaft extending therefrom and said shaft connected to said drive mechanism;
(f) said second means includes a second flat actuator;
(g) said operator includes a tube member having an upper and a lower end and wherein said first actuator is pivotally associated with said upper end and said second actuator is pivotally associated with said lower end;
(h) each of said first and second actuators includes arcuate bearing surfaces cooperating with said tube member;
(i) said bearing surfaces of said first and said second actuators have substantially equal radii of curvature; and,
(j) said first and said second actuators are substantially rectangularly-shaped.

2. An operator as in claim 1, wherein:
(a) said operator includes a universal joint.

3. An operator as in claim 1 wherein:
(a) said first actuator and said second actuator being slideably mounted inside said tube member.

4. An operator as in claim 1, wherein:
(a) said tube member's shape in the area of bearing generally corresponds to the shape of said first and said second actuators respectively.

5. An operator as in claim 1, wherein:
(a) said tube member is hollow and said first and said second actuators are adapted for internal positioning therein.

6. An operator as in claim 5, wherein:
(a) said first and said second actuators are substantially identical in size.

7. An operator as in claim 6, wherein:
(a) said drive mechanism includes cylinder means disposed transversely of said first actuator shaft.

8. An operator as in claim 6, wherein:
(a) said operator being displaceable from a first position connecting said first and said second means to a second position not in contact with said second means and permiting access to said second means.

9. An operator as in claim 8, further comprising:
(a) a first aperture in said operator, said first aperture being transverse of said fixed axis;
(b) a second aperture in said operator;
(c) a locking member insertable in said first aperture to positively position said operator for connecting said first and said second means when positioned in said first aperture and insertable in said second aperture to maintain said operator in said second position to permit access to said second means.

10. An operator as in claim 9, wherein:
(a) said locking member when inserted in said second aperture bears against said first actuator.

11. An assembly as defined in claim 1 wherein:
(a) each of said actuators is square.

12. A displacable universal joint for a twistlock mechanism with a drive mechanism having a fixed axis and an angularly displacable twistlock having a pivot axis normally positioned along said fixed axis, comprising:
(a) a first and a second actuator and said first actuator drivingly connected to said drive mechanism for rotating said first actuator and said second actuator connected to said twistlock;
(b) each of said actuators is generally rectangularly shaped and each of said actuators has arcuate side bearing surfaces and said bearing surfaces have substantially equal radii of curvature; and,
(c) a tube means is pivotally connected to each of said actuators for drivingly connecting said actuators and causing cooperative rotation thereof whereby said tube means maintains driving connection between said actuators when said twistlock pivots and thereby displaces said pivot axis from said fixed axis.

13. The universal joint as defined in claim 12, wherein:
(a) said tube means is hollow and has an upper end and a lower end; and,
(b) said first actuator is slidingly received in said upper end and said second actuator is slidingly received in said lower end whereby said tube means is selectively displacable out of driving connection with said second actuator.

14. The universal joint as defined in claim 13, wherein:
(a) means are associated with said tube means for maintaining said tube means in driving connection with said second actuator.

15. The universal joint as defined in claim 14, wherein:
(a) said means adapted for selectively maintaining said tube means out of driving engagement with said second actuator.

16. The universal joint as defined in claim 15, wherein:
(a) said means includes first and second spaced apertures in said tube means and a pin means selectively positionable in one of said apertures whereby positioning of said pin means in said second aperture when said tube means drivingly connects said actuators maintains said tube means in driving connection and positioning of said pin means in said first aperture when said tube means is out of driving engagement with said second actuator maintains said tube means out of driving engagement with said second actuator.

17. The universal joint as defined in claim 16, wherein:
(a) said first aperture is disposed closely adjacent one of the sides of said tube means and said second aperture is disposed substantially equidistant two parallel sides of said tube means.

18. The universal joint as defined in claim 12, wherein:
(a) said actuators are square.

19. The universal joint as defined in claim 13, wherein:
(a) said drive mechanism includes a cylinder and piston assembly.

* * * * *